United States Patent [19]

Clark

[11] Patent Number: 4,796,766

[45] Date of Patent: Jan. 10, 1989

[54] PLASTIC CONTAINER AND METHOD OF FORMING SAME

[75] Inventor: Richard E. Clark, Merrimack, N.H.

[73] Assignee: The Continental Group, Inc., Norwalk, Conn.

[21] Appl. No.: 364,563

[22] Filed: Apr. 1, 1982

[51] Int. Cl.[4] ..... B65D 1/02; B65D 1/06; B29C 49/16; B29C 49/17

[52] U.S. Cl. ..... 215/1 C; 264/159; 264/527; 264/532; 264/536; 428/542.8; 428/35.8; 428/36.92

[58] Field of Search ..... 215/1 C; 150/55; 220/62; 264/527, 159, 532, 523, 536; 425/522, 538; 428/35, 542.8

[56] References Cited

U.S. PATENT DOCUMENTS

| | | | |
|---|---|---|---|
| Re. 23,564 | 10/1952 | Hobson | 425/538 X |
| 3,294,885 | 12/1966 | Cines et al. | 264/527 |
| 3,304,603 | 2/1967 | Piker | 264/527 X |
| 3,328,498 | 6/1967 | Cheney | 264/527 X |
| 3,428,722 | 2/1969 | Chittenden et al. | 264/527 X |
| 3,432,586 | 3/1969 | Stenger | 264/527 |
| 3,457,590 | 7/1969 | Dittmann | 264/527 X |
| 3,525,123 | 8/1970 | Clines et al. | 264/527 X |
| 3,784,038 | 1/1974 | Uhlig | 215/1 C |
| 3,862,698 | 1/1975 | Hafele | 215/1 C |
| 3,872,203 | 3/1975 | Yoshikawa et al. | 264/532 |
| 4,125,632 | 11/1978 | Vosti et al. | 215/1 C X |
| 4,281,769 | 8/1981 | Ignell | 215/1 C X |
| 4,356,926 | 11/1982 | Priestly et al. | 215/1 C X |
| 4,406,854 | 9/1983 | Yoshino | 215/1 C X |

FOREIGN PATENT DOCUMENTS

| | | | |
|---|---|---|---|
| 1120221 | 3/1982 | Canada | 264/523 |
| 1540333 | 9/1968 | France | 425/522 |
| 51-91967 | 8/1976 | Japan | 264/527 |
| 6615449 | 5/1967 | Netherlands | 264/527 |
| 1167513 | 10/1969 | United Kingdom | 264/536 |
| 2041286 | 9/1980 | United Kingdom | 215/1 C |
| 2104825 | 3/1983 | United Kingdom | 264/527 |

*Primary Examiner*—Sue A. Weaver

*Attorney, Agent, or Firm*—Charles E. Brown; Paul Shapiro; Charles A. Brown

[57] ABSTRACT

This relates to blow molded containers, and particularly to the formation of blow molded containers formed of a plastic material which is subjectable to a high degree of biaxial orientation for maximum strength. Two containers are formed in each blow molding operation with each container having throughout the stress areas thereof a high degree of biaxial orientation. A container may be in the form of a bottle having an as formed open bottom which is closed by a metal end unit seamed in place. Other containers will have open mouths closed by conventional closures including metal end units which are seamed to the container body or by closure caps which may be releasably interlocked with the neck finish of the container in several known modes. In every instance the containers are formed with a minimum of scrap. This abstract forms no part of the specification of this application and is not to be construed as limiting the claims of the application.

18 Claims, 2 Drawing Sheets

76
72
70
74

76
72
70
74
78
80

84
CUT
88
94
90
82
CUT
CUT
92
90

86
82
CUT
CUT
94
86

82
86
92
92
86

98
96
90
86
88

100
102
104

110
108
106

116
114
112

PLASTIC CONTAINER AND METHOD OF FORMING SAME

This invention relates in general to new and useful improvements in blow molded plastic containers, and more particularly to the simultaneous forming of two containers as part of an intermediate article of manufacture wherein both containers have a high degree of biaxial orientation.

In the past, multiple containers have been formed by clamping an extruded tube in a multiple cavity blow mold, piercing the center part of the extruded tube with a blow needle, and then simultaneously blowing the two end portions of the extruded tube in a conventional manner to define two separate and apart containers joined by a central ring portion which is readily cut therefrom. Such containers are deficient in that while there has been the desired degree of hoop stretching, there has been no axial elongation and therefore, for all practical purposes, the plastic material of such containers is oriented only in the hoop direction and there is little or no biaxial orientation as is desired for shape maintaining containers.

In accordance with this invention, it is proposed to begin with an injection molded preform having an open neck portion by which the preform and the resultant blow molded intermediate article may be readily handled and through which the necessary blowing gas may be introduced. Such preform is both shorter than and of a small diameter than the resultant blow molded intermediate article, and thereby, except in the open neck portion, there is a high degree of biaxial orientation.

In accordance with this invention, there is blow molded in a customary manner an intermediate article which includes two individual containers joined by a center ring portion which is of a different diameter from that of adjacent portions of the containers whereby the open ends of the blow molded containers, when severed from the ring member, are provided with seaming flanges at their open ends, the seaming flanges having a high degree of biaxial orientation wherein cracking during the seaming of a metal end unit thereto does not occur.

A wide variety of container configurations is feasible in accordance with the invention, and several only will be illustrated. Basically, the two containers may be axially aligned with each other and with the open neck portion of the preform, or may be axially aligned with each other but transversely of the axis of the preform. In one embodiment of the invention, a conventional bottle is blow molded except that it has no bottom, and in accordance with this invention a metal bottom unit will be seamed thereto in a conventional manner. Other containers will be open mouth jar-like members which may be provided with metal end units seamed thereto or which may have threads so as to receive closure caps.

With the above and other objects in view that will hereinafter appear, the nature of the invention will be more clearly understood by reference to the following detailed description, the appended claims, and the several views illustrated in the accompanying drawings.

IN THE DRAWINGS

Figure 5:
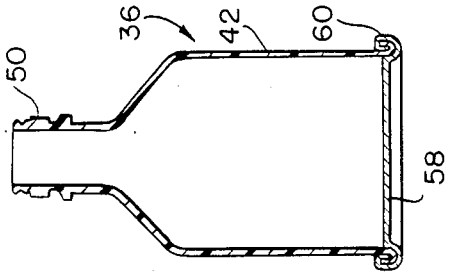
FIG. 5 is an axial sectional view of one of the containers of FIG. 4 after the bottom thereof has been closed with a metal bottom end unit.

Referring now to the drawings in detail, reference is first made to FIGS. 1–6 wherein there is illustrated a typical embodiment of the invention.

Figure 1:
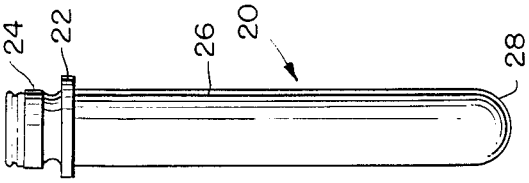
FIG. 1 is an elevation view of a preform utilized in accordance with this invention.

In FIG. 1 there is illustrated a conventional type of injection molded preform 20 which is provided with the usual carrier flange 22 and an externally threaded neck finish 24. The preform 20 will have a generally cylindrical body 26 and a closed bottom 28 which normally will generally be in the form of a hemisphere.

Figure 3:
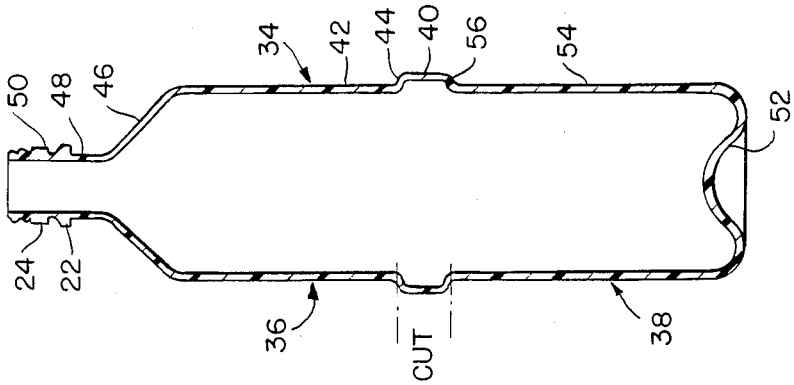
FIG. 3 is an axial sectional view through a blow molded intermediate article formed by blow molding the preform of FIG. 1 in the mold of FIG. 2.
Figure 2:
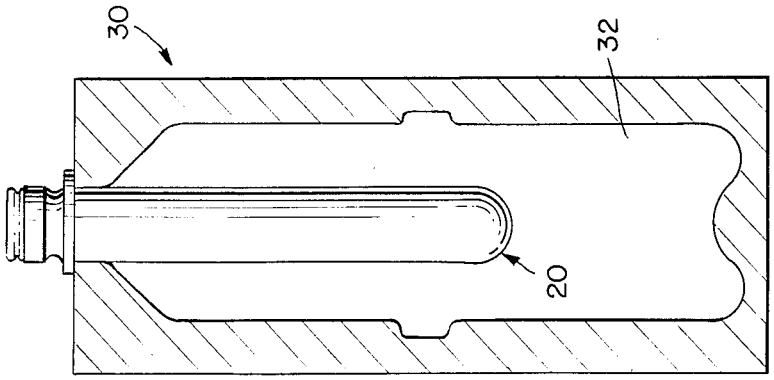
FIG. 2 is an axial sectional view taken through a blow mold having positioned therein the preform of FIG. 1 preparatory to a blow molding operation.

In FIG. 2 there is illustrated a conventional type of longitudinally split blow mold in which the preform 20 of FIG. 1 is mounted, the blow mold being generally identified by the numeral 30. The blow mold 30 is provided with a cavity 32 which is axially elongated and which is configurated to effect the blow molding of the preform 20 into an axially elongated generally cylindrical member which is best illustrated in FIG. 3 and is identified by the numeral 34. The member 34 is an intermediate article of manufacture and is configurated so as to define an upper container 36 and a lower container 38 joined by an annular ring member 40. Most specifically, it will be seen that the upper container 36 includes an open bottom cylindrical body 42 joined to the ring member 40 by a radially outwardly directed annular flange 44. The upper end of the body 42 is provided with a shoulder 46 which terminates in a neck 48 which is open and which has an external neck finish 50 in accordance with the injection molded neck finish of the preform 20 including the threads 24 and shoulder or collar 22.

The container 38 is provided, in the illustrated embodiment, with a bottom 52 which is of the so-called champagne bottom configuration so as to withstand internal pressures. The container 38 also includes a cylindrical body 54 which has an open upper end and which terminates in a radially outwardly directed flange 56 which corresponds to the flange 44 of the container 36 and is integrally joined to the ring member 40.

Figure 4:
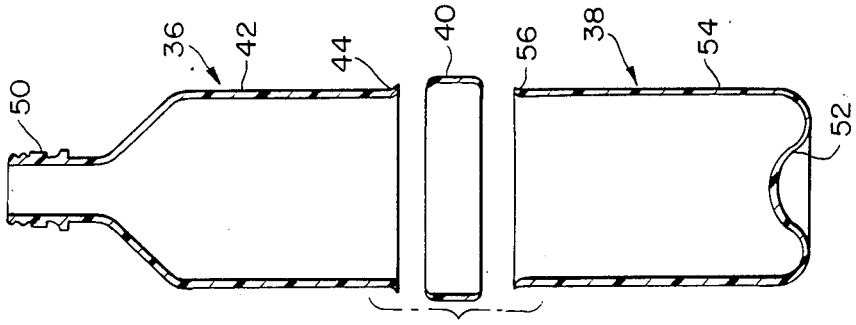
FIG. 4 is an exploded axial sectional view of the intermediate article showing the same separated into two containers and a scrap ring member.

As is schematically illustrated in FIG. 4, the flanges 44 and 56 are separated from the ring member 40 in any desired conventional manner so that the containers 36 and 38 become separted from the ring member 40 with the ring member 40 becoming trim scrap. With respect to the container 36, the portion of the flange 44 remaining integral with the body 42 becomes a lower seaming flange. In a like manner, the portion of the flange 56 remaining integral with the body 54 of the container 38 becomes an integral seaming flange.

As is shown in FIG. 5, the container 36, which in the illustrated embodiment of the invention is a bottle, has the open bottom thereof closed by means of a metal end unit 58 which is sealed to the body 42 by means of a conventional folded seam 60, such as a double seam, incorporating the seaming flange 44. The top of the container 36 may be filled through the neck thereof and then closed in the conventional manner.

At this time it is pointed out that when the container 36 is to be packaged with a beverage under high internal pressure, as in the instance of carbonated beverages, and the container 36 is made in accordance with the illustrations of FIGS. 1–4, it has been found that the forming of the end unit 58 of steel and the double seaming thereof to the body 42 is less costly than the cost of the plastic material normally required to form a bottom integral with the body 42 that will withstand the relatively high internal pressures on the order of 80 p.s.i. and above.

Figure 6:
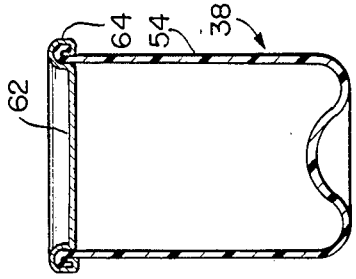
FIG. 6 is an axial sectional view through the other of the containers of FIG. 4 after the open mouth thereof has been closed utilizing a metal end unit.

Referring now to FIG. 6, it will be seen that the container 38 is illustrated with a conventional type of metal end unit 62 which is secured to the container body 54 utilizing the seaming flange 56 by way of a conventional seam, such as a double seam 64.

With respect to the end unit 62, it is to be understood that it will vary with the product and may be of the easy opening type wherein, should the product be a liquid which can be poured therefrom, will have only a small removable panel portion, or it may be of the full opening type. It is also feasible that the end unit could be of the conventional type having a plastic window which may be cut out for dispensing purposes, or the end unit 62 could be of a two-piece construction and include a conventional outer ring and a removable plug member as in the case of paint cans and the like. It is also feasible in the case of the full opening end unit to provide a suitable sealable cover which will snap into interlocking engagement with the seam 64 in a known manner.

Figures 7, 8, 9, 10, 11, 12, 13, 14, 15:
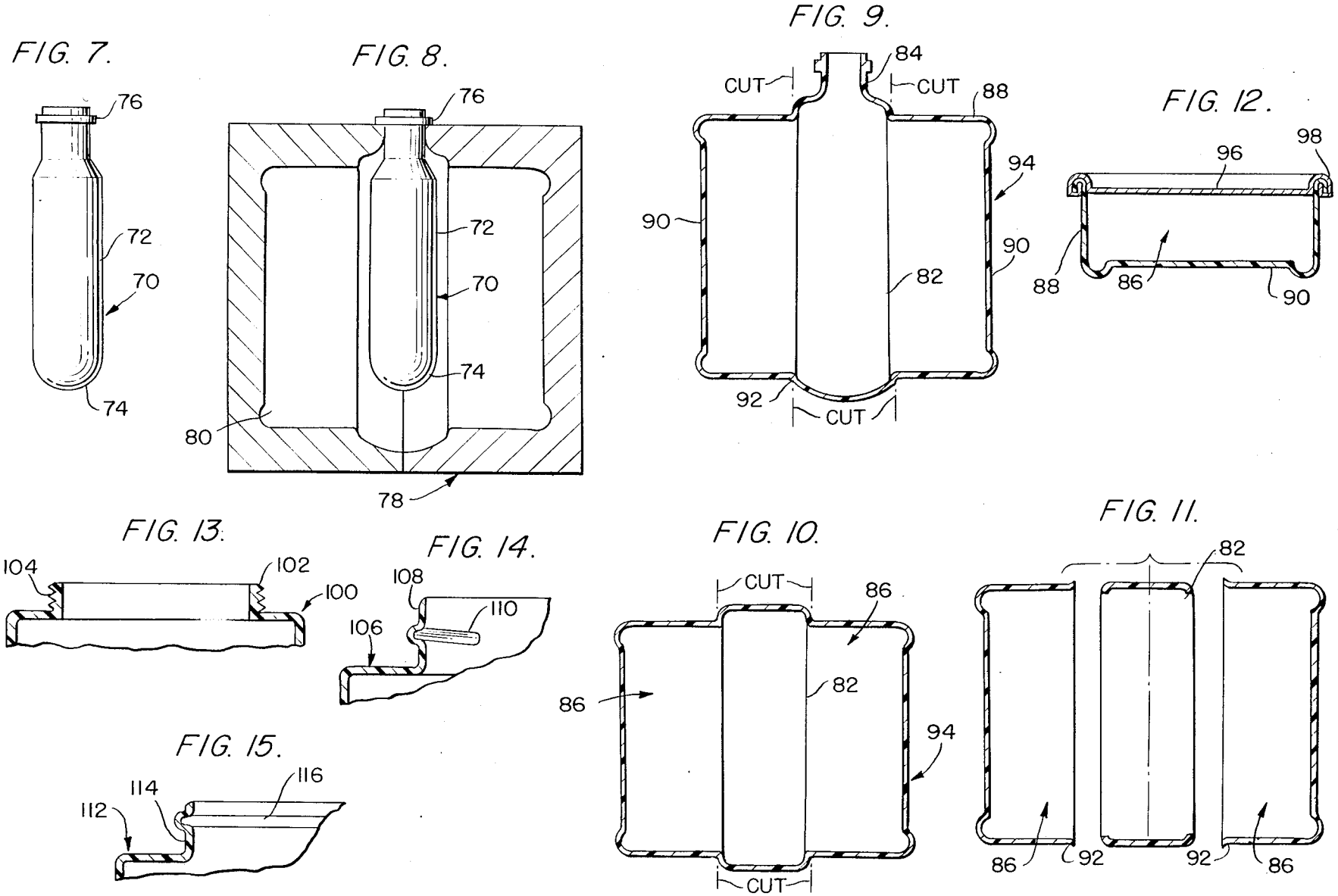
FIG. 7 is an elevation view of a slightly modified preform.
FIG. 8 is an axial sectional view taken through a blow mold having positioned therein the preform of FIG. 7 prior to a blow molding operation.
FIG. 9 is an axial sectional view through an intermediate article blow molded from the preform of FIG. 7 in the blow mold of FIG. 8.
FIG. 10 is a bottom view of the intermediate article of FIG. 9.
FIG. 11 is an exploded bottom view of the intermediate article of FIG. 10 with the two blow molded containers separated from the central ring member which becomes scrap.
FIG. 12 is a sectional view through one of the containers of FIG. 11, and shows the same closed by means of a metal end unit.
FIG. 13 is an axial sectional view through a blow molded container similar to that of FIG. 6 wherein the container is provided with a reduced diameter, externally threaded mouth for receiving a screw threaded closure cap.
FIG. 14 is an enlarged fragmentary elevational view of an upper portion of a modified form of the jar of FIG. 13 wherein the mouth neck portion is provided with closure cap retaining lugs.
FIG. 15 is an enlarged fragmentary elevational view of still another form of open mouth container neck finish having a peripheral bead wherein the container may be closed by a snap-on closure cap.

Reference is now made to FIGS. 7–12 wherein there is illustrated a different embodiment of the invention. In FIG. 7 there is illustrated a preform 70 which is similar to the preform 20, but wherein the threaded neck portion has been eliminated. The preform 70 will include the usual body 72 having a closed lower end 74 and is provided at its upper end with a support collar or shoulder 76 to facilitate handling of the preform and the article which is blow molded therefrom.

In FIG. 8 there is illustrated one-half of a conventional split blow mold 78 which has a cavity 80 therein defining an article to be blow molded from the preform 70, the article being best shown in FIGS. 9 and 10.

The cavity 80 will be so configurated wherein the blown article will include a central ring member 82 from which a neck portion 84 projects in the original axial direction of the preform. As each side of the ring member 84 there is formed containers 86 with the containers 86 being preferably identical but not necessarily so. Each container 86 will include a body 88 having at one end thereof a bottom 90 which may be of the illustrated recessed type. The opposite end of the body 88 is open and has radially extending therefrom an annular flange 92.

The blow molded article illustrated in FIGS. 9 and 10 is an intermediate article of manufacture and is generally identified by the numeral 94. After it has been removed from the mold, it is cut along circular cut lines in the manner schematically shown in FIGS. 9 and 10 to define a central element in the form of the ring member 82, which becomes scrap, and the two containers 86. The formation of the containers 86 is now complete.

Reference is now made to FIG. 12 wherein there is shown the manner in which a typical container 86 may be closed by means of a metal end unit 96 which is secured to the body 88 by way of a conventional seam, preferably a double seam 98. It is to be understood that the seaming flanges 92 are utilized in forming the seam 98.

It is to be understood that the end unit 96 may be of an easy opening type or other type as described with respect to the end unit 62 of FIG. 6.

It is also pointed out here that the containers 38 and 86 need not be restricted to containers which are closed by metal end units which are double seamed in place. In FIG. 13 there is illustrated a modified container 100 which has a reduced diameter neck 102 that is provided with external threads 104 for receiving a conventional screw threaded closure cap. In FIG. 14 there is illustrated a similar container 106 which has a neck finish 108 incorporating conventional lugs 110 for cooperation with somewhat similar lugs on the closure cap.

Finally, in FIG. 15 there is illustrated a container 112 which also has a reduced diameter neck finish 114 which is provided with a continuous annular rib 116 beneath which a conventional closure cap of the snap-on type may be readily interlocked.

It will be readily understood from the foregoing that the containers with open mouths may be suitably closed by other conventional closures and that the neck finish may be modified in a conventional manner to receive such closures.

Although only general reference has been made to the injection molding of the preforms of plastic material, it is to be understood that at the present the acceptable plastic material is polyethynene terephthalate for many products. However, the invention is not so limited, and other plastic materials which when properly stretched will have a high degree of biaxial orientation may be utilized.

Although only several preferred embodiments of the invention have been specifically illustrated and described herein, it is to be understood that minor variations may be made in the process and resultant articles without departing from the spirit and scope of the invention as defined by the appended claims.

I claim:

1. A method of simultaneously forming two blow molded plastic containers, said method comprising the steps of providing a tubular preform having an open end and a closed end, placing said preform in a blow mold cavity of greater length than said preform, introducing a blowing gas into said preform through said preform open end and blow molding said preform with the stretching of said preform both axially and radially to an intermediate shape defining at least two containers each having an open end defined by a radially outwardly directed biaxially oriented seaming flange with said flanges being generally in opposed relation, said preform open end remaining constant, and cutting said intermediate shape to separate and define said two containers.

2. A method according to claim 1 wherein said flanges prior to cutting of said intermediate shape are joined together by way of an integral ring member free of joints.

3. A method according to claim 2 wherein said ring member is removed to separate said containers.

4. A method according to claim 2 wherein said preform open end projects from said ring member.

5. A method according to claim 2 wherein said ring member has an axis extending in the same general direction as an original axis of said preform.

6. A method according to claim 2 wherein said ring member has an axis extending generally normal to the original axis of said preform.

7. A method according to claim 1 wherein said preform open end forms a mouth of one only of said containers.

8. A method according to claim 1 wherein said containers are identical.

9. A method according to claim 1 wherein said preform open end forms one end of one of said containers, and the open end of said one container is the bottom of said one container.

10. A method according to claim 1 wherein said open end of said one container is closed by a metal bottom seamed to said one container.

11. An intermediate article of manufacture comprising an integral blow molded hollow plastic member having an open neck portion and at least two separate containers integrally joined together, and each of said containers has an open end defined by a biaxially oriented seaming flange.

12. An intermediate article according to claim 11 wherein said open neck portion has an axis disposed generally coaxially of said containers.

13. An intermediate article according to claim 11 wherein said open neck portion has an axis disposed normal to the axis of said containers.

14. An intermediate article according to claim 11 wherein said containers have open tops arranged in opposed relation and joined together by a central annular ring member.

15. An intermediate article according to claim 11 wherein one of said containers has an open bottom, and said open neck portion forms part of said one container, and the other of said containers has an open top and a closed bottom.

16. An intermediate article of manufacture according to claim 11 wherein two separate containers are joined together by an intermediate ring member free of joints and connecting together said seaming flange.

17. A blow molded plastic container comprising a biaxially oriented tubular body having one end open and a second end defined by a shoulder joined to a tubular neck, and a metal bottom seamed to said body enclosing said one open end, said tubular neck being of an injection molded construction.

18. A blow molded plastic container comprising a biaxially oriented tubular body having one end open and a second end defined by a shoulder joined to a tubular neck, and a metal bottom seamed to said body enclosing said one open end, said body having at said open one end a biaxially oriented peripheral seaming flange forming part of the seam between said body and said bottom.

* * * * *